United States Patent [19]

Kaneko

[11] Patent Number: 4,989,435

[45] Date of Patent: Feb. 5, 1991

[54] METHOD AND APPARATUS FOR MANUFACTURING CURVED PIPE

[75] Inventor: Toshio Kaneko, Kanagawa, Japan

[73] Assignee: Kabushiki Kaisha Asahi Kinzoku Hogyosho, Kanagawa, Japan

[21] Appl. No.: 449,581

[22] Filed: Dec. 11, 1989

[51] Int. Cl.[5] ..... B21D 7/08; B21D 9/12

[52] U.S. Cl. ..... 72/133; 72/134; 72/166; 72/369

[58] Field of Search ..... 29/157 A; 72/133, 134, 72/166, 169, 369, 426, 427

[56] References Cited

U.S. PATENT DOCUMENTS 4,759,206 7/1988 Kaneko ..... 72/134
4,875,353 10/1989 Kaneko ..... 72/134 X
4,876,872 10/1989 Kaneko ..... 72/134 X

FOREIGN PATENT DOCUMENTS 58-202918 11/1983 Japan ..... 72/133

*Primary Examiner*—E. Michael Combs
*Attorney, Agent, or Firm*—Flynn, Thiel, Boutell & Tanis

[57] ABSTRACT

A curved pipe manufacturing method comprises the steps of providing a fixed die having a curved cavity, an entrance opening and an exit opening contained therein, the curved cavity being formed in a circular arc and extending from the entrance opening to the exit opening, providing a movable block having a curved mandrel attached to one side thereof and an ejecting rod on the side thereof opposite to the curved mandrel, inserting the curved mandrel into the curved cavity of the fixed die through the exit opening therein and forming a curved annular chamber inside the cavity, pressing a work with a presser rod through the entrance opening into the curved annular chamber to form a curved pipe, providing a stopper through hole adjacent to the exit opening of the fixed die so that the through hole of the stopper is positioned in a turning track of the mandrel and restrains the tip end of the curved pipe, moving the movable block so as to remove only the mandrel from the exit opening while the curved pipe is restrained from movement by the stopper, inserting the ejecting rod into the entrance opening so as to extract the curved pipe from the exit opening of the fixed die, and recovering the curved pipe. An apparatus for carrying out the curved pipe manufacturing method is provided.

6 Claims, 5 Drawing Sheets

METHOD AND APPARATUS FOR MANUFACTURING CURVED PIPE

BACKGROUND OF THE INVENTION

1. Field of the Invention

The present invention relates to a curved pipe manufacturing method and an apparatus for carrying out the same in which a straight pipe of a stainless steel or the like is pressed into a fixed die having a curved cavity of a circular arc to form a curved pipe.

2. Description of the Prior Art

U.S. Pat. No. 4,759,206 discloses a curved pipe manufacturing method employing an apparatus as illustrated in FIG. 7, invented by the inventor of the present invention. According to this known curved pipe manufacturing method and apparatus, a work, namely, a straight pipe 65, is pressed with a presser rod 69 into a curved space, which conforms to the shape of a curved pipe to be formed and is defined by a curved cavity 64 formed in a fixed die 61 so as to extend from an entrance opening 62 to an exit opening 63 of the fixed die 61, and a curved mandrel 67 is secured to a movable block 66 so as to be inserted into and removed from the curved cavity 64 of the fixed die 61, through the exit opening 63 of the fixed die 61, to form a curved pipe. The movable block 66 is turned to remove only the mandrel 67 from the fixed die 61, and then the movable block 66 is turned further to insert an ejecting rod 68, attached to the movable block 66 opposite to the mandrel 67, into the curved cavity 64 of the fixed die 61, from the entrance opening 62 of the fixed die 61, to thereby push out the curved pipe from the fixed die 61 with the ejecting rod 68, characterized in that, in the middle of pressing the work into the curved space by the presser rod from the entrance opening 62, the action of presser rod 69 is interrupted in pressing the work 65 into the curved space and the mandrel 67 is removed slightly from a curved portion of the work 65 and then the advancement of the presser rod 69 is restarted to press the work 65 further into the curved space to complete the curved pipe.

However, according to the known method and apparatus, inasmuch as in the middle of manufacturing the curved pipe, there are steps of interrupting the action of the presser rod in pressing the work into the curved space and slightly removing the mandrel from a curved portion of the work and then restarting the advancement of the presser rod to press the work further into the curved space to complete the curved pipe, problems arise in that the curved pipe accompanies the mandrel 7 during its removal, e.g., the curved pipe is extracted from the exit opening 3 together with the mandrel 7 as well as the process for manufacturing a curved pipe being complicated and the apparatus for carrying out the same also being complicated.

SUMMARY OF THE INVENTION

Accordingly, it is an object of the present invention to provide a curved pipe manufacturing method and an apparatus for carrying out the same which eliminates the foregoing drawbacks of the known curved pipe manufacturing methods and apparatuses and is capable of enabling the manufacture of a curved pipe in one step to thereby simplify the manufacturing process and apparatus for carrying out the same.

It is another object of the present invention to provide a curved pipe manufacturing method and an apparatus for carrying out the same which enables the restraint of the tip end of the curved pipe by a stopper so that only the mandrel will be removed from the fixed die and the curved pipe is prevented from being exracted from the fixed die during the turning of the mandrel.

It is a further object of the present invention to provide a curved pipe manufacturing method and an apparatus for carrying out the same which uniformly enables the extraction of the curved pipe from the fixed die to thereby facilitate the extraction of the curved pipe with ease.

It is a still further object of the present invention to provide a manufacturing method and an apparatus for carrying out the same which can be automated with ease with the use of simple sensors to thereby increase the working efficiency remarkably.

It is a still further object of the present invention to provide a manufacturing method and an apparatus for carrying out the same which enables the supplying of a work to the fixed die with ease and presses the work into the fixed die by the arrangement of a movable supporting member at an entrance opening of the fixed die.

To achieve the above objects, the curved pipe manufacturing method of the present invention comprises the steps of providing a fixed die having a curved cavity, an entrance opening and an exit opening contained therein, the curved cavity being formed in a circular arc and extending from the entrance opening to the exit opening; providing a movable block having a curved mandrel attached to one side thereof and an ejecting rod on the other side thereof opposite to the curved mandrel; inserting the curved mandrel into the curved cavity of the fixed die through the exit opening therein and forming a curved annular chamber inside the cavity; pressing a work with a presser rod through the entrance opening into the curved annular chamber to form a curved pipe; providing a stopper having a through hole at a portion adjacent to the exit opening of the fixed die so that the through hole of the stopper is positioned in the turning track of the mandrel and can restrain a tip end of the curved pipe; moving the movable block so as to remove only the mandrel from the exit opening while the curved pipe is restrained from movement by the stopper so as to not accompany the removal of the mandrel, inserting the ejecting rod into the entrance opening so as to eject the curved pipe from the exit opening of the fixed die; and recovering the curved pipe.

A curved pipe manufacturing apparatus according to the present invention comprises a fixed die having a curved cavity, an entrance opening and an exit opening contained therein, the curved cavity being formed in a circular arc and exending from the entrance opening to the exit opening; a movable block having a curved mandrel attached to one side thereof, an ejecting rod attached to the other side thereof opposite to the curved mandrel and a groove provided therein at the side of the exit opening of the fixed die, the groove being capable of receiving a stopper, the movable block being mounted for circular movement so as to insert the curved mandrel into the exit opening of the fixed die to form a curved annular chamber therein and to remove the curved mandrel from the exit opening; and a stopper having a through hole mounted for reciprocating movement into and out of the groove, the through hole of the stopper being positioned in the turning track of the mandrel when the stopper is inserted into the groove for permitting only the mandrel to pass therethrough and be removed from the exit opening of the fixed die but prevent the curved pipe from passing therethrough without being accompanied by the removal of the mandrel during the circular movement of the movable block, the ejecting rod being capable of movement into the entrance opening of the fixed die during the further circular movement of the movable block so as to eject the curved pipe through the exit opening of the fixed die; a presser rod for pressing a work into the curved annular chamber from the entrance opening of the fixed die, and a controller means for regulating a driving mechanism of the stopper for the curved pipe to be restrained during the removal of the mandrel from the exit opening.

The above and other objects, features and advantages of the present invention will become more apparent from the following description taken in conjunction with the accompanying drawings.

DESCRIPTION OF THE PREFERRED EMBODIMENT

Figure 1:
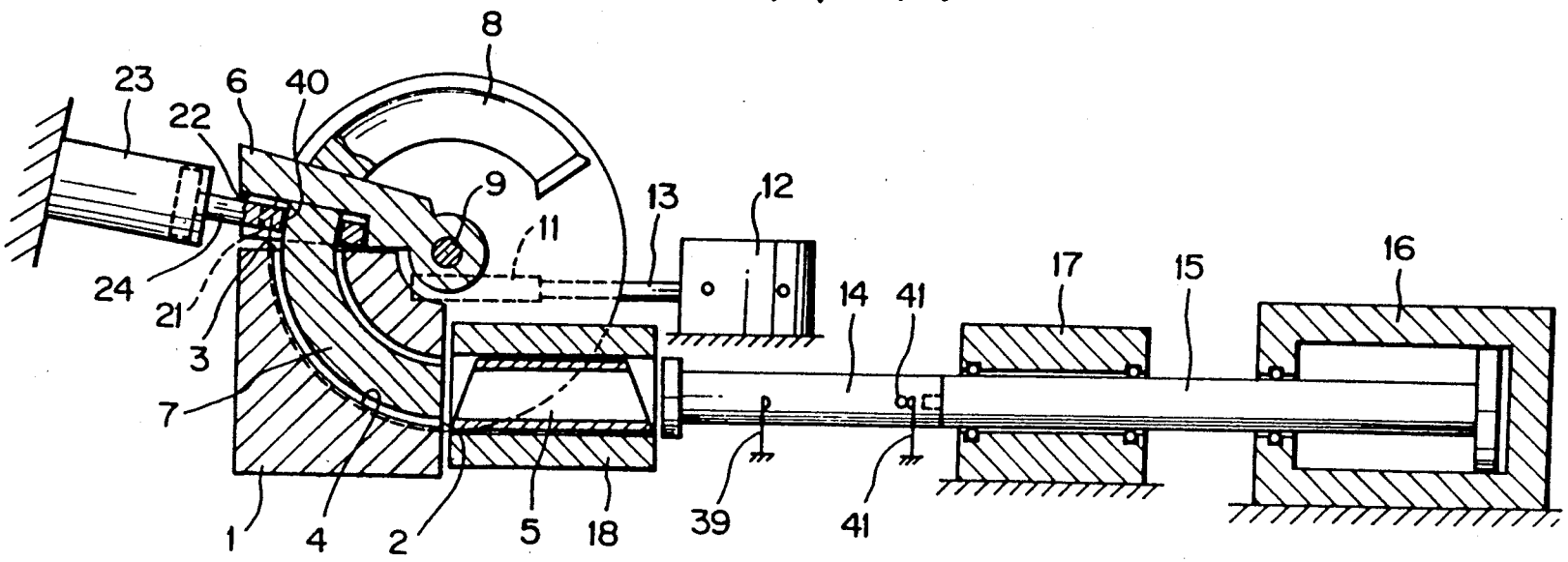
FIG. 1 is a sectional side elevation of a curved pipe manufacturing apparatus, in a preferred embodiment, for carrying out a curved pipe manufacturing method according to the present invention.
Figure 2:
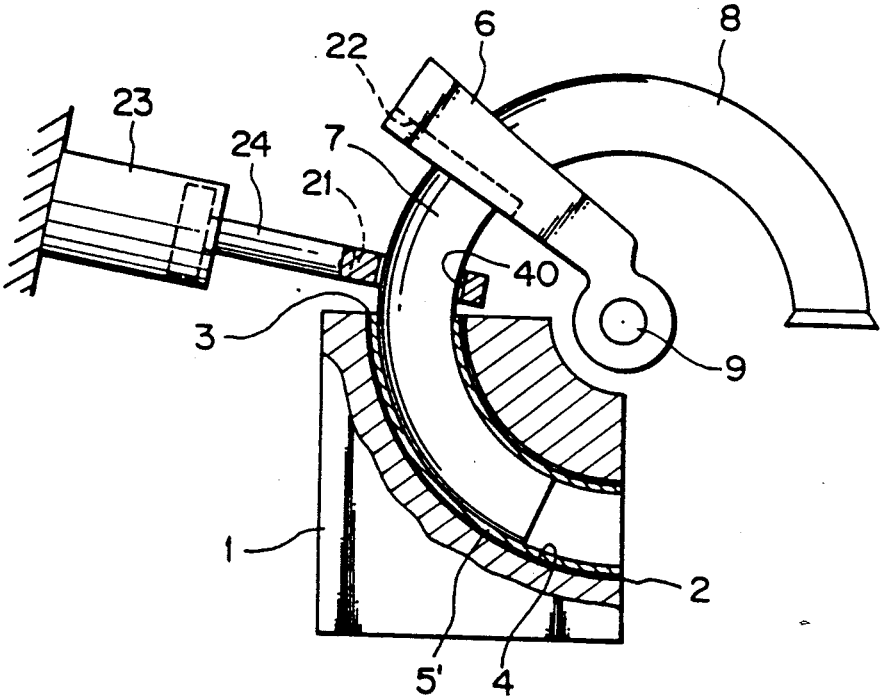
FIG. 2 is a view illustrating the state where the mandrel is removing from the fixed die.
Figure 3:
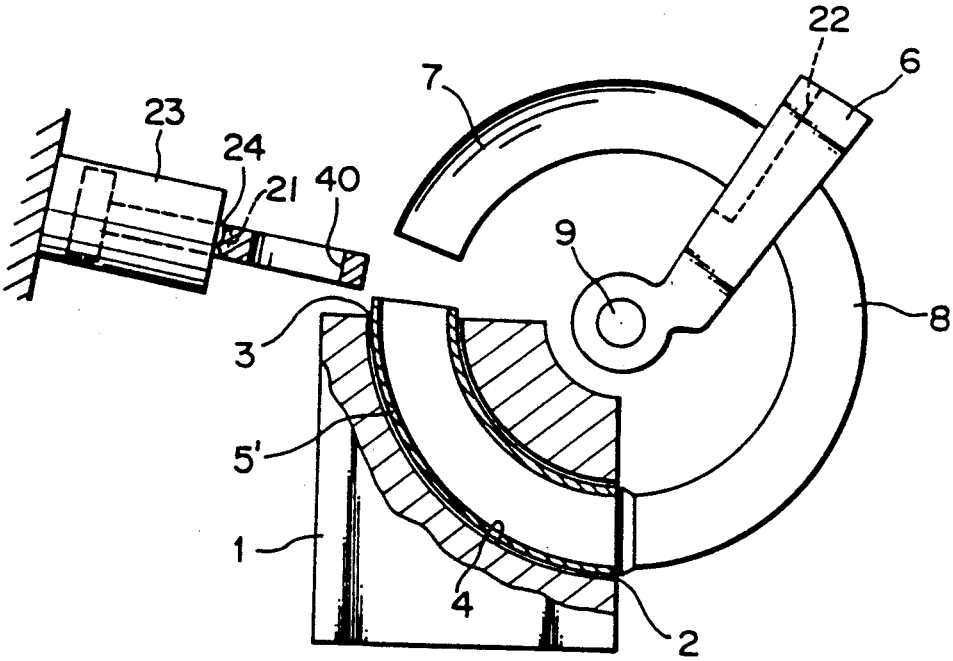
FIG. 3 is a view illustrating the state where the mandrel is removed from a stopper.

First Embodiment (FIGS. 1 to 4 and FIG. 6)

A curved pipe manufacturing apparatus, in a preferred embodiment, according to the present invention will be described with reference to FIGS. 1 to 5.

A fixed die 1 has a curved cavity 4 which is of a circular arc configuration and has an entrance opening 2 and an exit opening 3. The edge of the entrance opening 2 is rounded to facilitate the pressing of a work 5, namely, a straight pipe, into the curved cavity 4. A movable block 6 is provided with a mandrel 7 on one side thereof and an ejecting rod 8 on the other side thereof. The curved cavity 4, the mandrel 7 and the ejecting rod 8 are concentric and respectively have the same curvature. The movable block 6 is fixed to a rotary shaft 9 and can be rotated about the rotary shaft 9. The diameter of the mandrel 7 is slightly smaller than the inside diameter of the work 5, while the diameter of the free end of the ejecting rod 8 is practically the same as the outside diameter of the work 5. The diameter of the curved cavity 4 is slightly greater than the outside diameter of the work 5.

Figure 4:
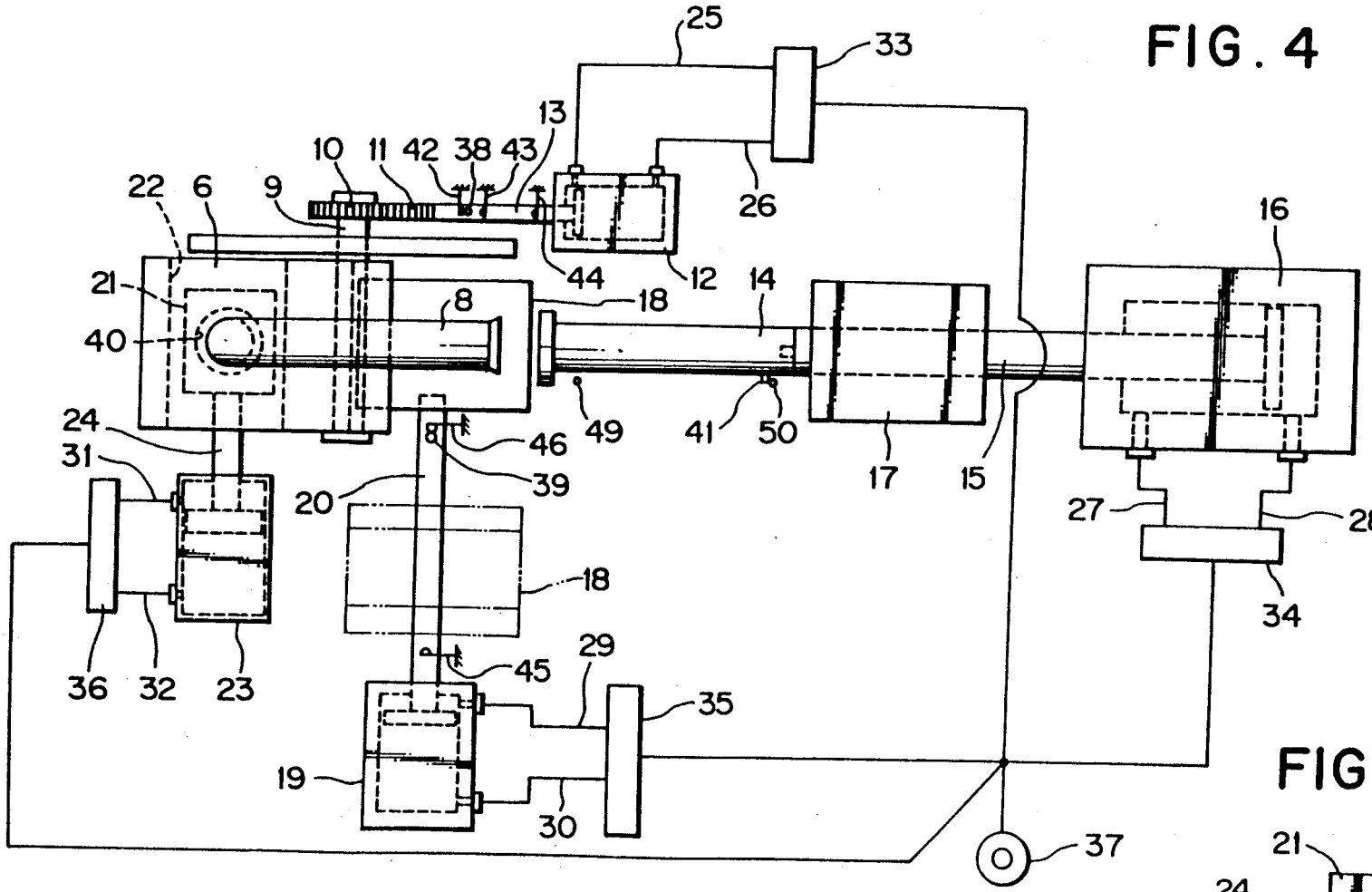
FIG. 4 is a plan view of the curved pipe manufacturing apparatus in FIG. 1.

As shown in FIG. 4, secured to one end of the rotary shaft 9 is a pinion 10 engaging a rack 11 joined to the free end of the piston rod 13 of a power cylinder 12.

A presser rod 14 for pressing the work 5 into the curved space formed between the surface of the curved cavity 4 of the fixed die 1 and the mandrel 7 has one end screwed onto the free end of the piston rod 15 of a power cylinder 16. The presser rod 14 is operated by the power cylinder 16. The diameter of the other end, i.e., the free end, of the presser rod 14 is substantially the same as the outside diameter of the work 5. A guide member 17 is disposed near the front end of the piston rod 15 to support and guide the piston rod 15. The free end of the piston rod 15 extends beyond the guide member 17 on the side of the fixed die 1 and is engaged with the presser rod 14.

A movable pipe supporting member 18 is disposed in front of the entrance opening 2 of the fixed die 1 so as to be moved toward and away from the entrance opening 2 of the fixed die 1 by a piston rod 20 of a power cylinder 19. The movable supporting member 18 is separated from the entrance opening 2 of the fixed die 1 and is located at a receiving position indicated by the imaginary lines in FIG. 2, where the work 5 is supplied into the movable supporting member 18.

The movable block 6 has a groove 22 for receiving a stopper 21 at the demarcation line between the movable block 6 and the mandrel 7. The stopper 21 is attached to a free end of a piston rod 24 of a power cylinder 23. The stopper has a through hole 40 through which the mandrel 7 can pass but the curved pipe 5' can not pass. Accordingly, although the mandrel 7 is turned through the movable stopper 6 when the mandrel 7 is removed from the curved cavity 4 of the fixed die 1 by turning the movable block 6 after the manufacture of the curved pipe 5' when the stopper 21 is inserted into the groove 22, the stopper 21 remains adjacent to the exit opening 3 to restrain the tip end of the curved pipe 5' whereby the curved pipe 5' always remains or is kept positioned in the curved cavity 4 of the fixed die 1 (Refer to FIG. 2).

Further successive turning of the movable stopper 6 allows the mandrel 7 to be removed from the through hole 40 of the stopper 21. Then, the stopper 21 is positioned out of the movable path or the turning track of the mandrel 7 by the retraction of the piston rod 24 of the power cylinder 23 (Refer to FIG. 3).

Still further turning of the movable block 6 allows the ejecting rod 8 to be inserted into the entrance opening 2 of the fixed die 1 so that the curved pipe 5', remaining in the curved cavity 4, is extracted from the exit opening 3 of the fixed die 1.

When the curved pipe 5' is completely extracted from the curved cavity 4, the stopper 21 is inserted into the groove 22 by the advance of the piston rod 24 of the power cylinder 23 so that the through hole 40 of the stopper 40 is positioned in the turning track of the mandrel 7 in preparation for manufacture of the next curved pipe.

Pressurized working fluid supply/return tubes 25 and 26, 27 and 28, 29 and 30, and 31 and 32 are connected to power cylinders 12, 16, 19 and 23, respectively. The pressurized working fluid supply/return tubes 25 and 26, 27 and 28, 29 and 30, and 31 and 32 are connected through selector valves 33, 34, 35 and 36, respectively, to a pressure generating machine such as an air compressor 37.

Projections 38, 39, and 41 are provided on the piston rods 13, 20 and and the presser rod 14, respectively. The projection 38 actuates sensors 42, 43 and 44; the projection 39 actuates sensors 45 and 46; and the projection 41 actuates sensors 49 and 50. When actuated, the sensors send signals to a controller 51, and then the controller 51 controls the selector valves 33, 34, 35 and 36 to control the operations of the power cylinders 12, 16, 19 and 23 according to the signals given thereto.

When the movable supporting member 18 is located at the receiving position indicated by the imaginary lines in FIG. 4, where the movable supporting member 18 receives the work 5, the mandrel 7 is located in place in the curved cavity 4 of the fixed die 1.

When actuated, the sensor 42 gives a signal to set the selector valve 33 at a position b, and the selector valve 35 at a position d to the controller 51. Consequently, the supply of working fluid to the power cylinder 12 is interrupted to stop the advance of the piston rod 13; the working fluid is supplied through the tube 30 into the rear chamber of the power cylinder 19; the working fluid is exhausted through the tube 29 from the front chamber of the power cylinder 19 to advance the piston rod 20 to move the movable supporting member 18 supporting the work 5 to a position immediately before the entrance opening 2 of the fixed die 1. The projection 39 of the piston rod 20 actuates the sensor 46. Then, the sensor 46 gives a signal to set the selector valve 35 at a position e, and the selector valve 34 at a position g to the controller 51. Consequently, the supply of working fluid to the power cylinder 19 is interrupted to stop the advancing motion of the piston rod 20; the working fluid is supplied through the tube 28 into the rear chamber of the power cylinder 16 and the working fluid is exhausted from the front chamber of the power cylinder 16 through the tube 27 to advance the piston rod 15, and thereby the work 5 supported on the movable supporting member 18 is pressed into the curved space formed between the inner surface of the fixed die 1 and the mandrel 7 through the entrance opening 2 by the tip end of the presser rod 14.

As the work 5 is pressed into the fixed die 1 by the presser rod 14, the work 5 is gradually bent in a circular arc. In proportion to the force of bending applied to the work 5, the force of contact between the work 5 and the mandrel 7 is increased. After the work 5 has been pressed into the fixed die 1 in substantially the entire length thereof, the projection 41 of the presser rod 14 actuates the sensor 49. Then, the sensor 49 gives a signal to set the selector valve 34 at a position i to the controller 51. Consequently, the working fluid is supplied through the tube 27 to the front chamber of the power cylinder 16 and the working fluid is exhausted from the rear chamber of the power cylinder 16 through the tube 28 to retract the piston rod 15 slightly, whereby the presser rod 14 is returned to a position remote from the fixed die 1, and the projection 41 actuates the sensor 50. Then, the sensor 50 gives a signal to set the selector valve 34 at the position h and the selector valve 35 to the position f to the controller 51. Consequently, supply of the working fluid to the power cylinder 16 is interrupted to stop the retracting motion of the piston rod 15; the working fluid is supplied through the tube 29 into the front chamber of the power cylinder 19 and the working fluid is exhausted from the rear chamber of the power cylinder 19 through the tube 30 to retract the piston rod 20, whereby the movable supporting member 18 is returned to its starting position. The projection 39 actuates the sensor 45 by the retracting motion of the piston rod 20.

The sensor 45 gives a signal to set the selector valve 35 at the position e, and the selector valve 33 at the position c to the controller 51. Consequently, the supply of working fluid to the power cylinder 19 is interrupted to stop the retracting motion of the piston rod 20; the working fluid is supplied through the tube 25 to the front chamber of the power cylinder 12 and the working fluid is exhausted from the rear chamber of the power cylinder 12 through the tube 26, so that the piston rod 13 is retracted and the rotary shaft 9 is turned with the rack 11 engaging the pinion 10, whereby the movable block 6 is turned away from the fixed die 1. As the movable block 6 is turned, the mandrel 7 is turned together with the movable block 6 but the curved pipe 5' remains always in the curved cavity 4 of the fixed die 1 since the stopper 21 restrains the tip end of the curved pipe 5'. With the retracting motion of the piston rod 13, the projection 38 actuates the sensor 43. At this state, the mandrel 7 is completely removed from the through hole 40 of the stopper 21.

The sensor 43 then gives a signal to set the selector valve 36 at position m to the controller 51. Consequently, working fluid is supplied through the tube 31 to the front chamber of the power cylinder 23 and the working fluid is exhausted from the rear chamber of the power cylinder 23 through the tube 32, so that the piston rod 24 retracts. As the piston rod 24 retracts, the through hole 40 of the stopper 21 is completely moved away from the turning track of the mandrel 7 (at the state shown in FIG. 3).

When the piston rod 13 was successively retracted, the ejecting rod 8 provided at the movable block 6 is inserted into the curved cavity 40 of the fixed die 1 through the entrance opening 2 whereby the curved pipe 5' is pushed outside by the ejecting rod 8 from the exit opening of the fixed die 1. At this time, inasmuch as the stopper 21 is positioned out of the movable path or discharging track of the curved pipe 5', the stopper 21 does not impede the discharge of the curved pipe 5'. Upon completion of the discharge of the curved pipe 5' by the ejecting rod 8, the projection 38 actuates the sensor 44.

The sensor 44 gives a signal to set the selector valve 36 at the position i and the selector valve 33 at the position a to the controller 51. Consequently, the working fluid is supplied through the tube 32 into the rear chamber of the power cylinder 23 and the working fluid is exhausted from the front chamber of the power cylinder 23 through the tube 31 to advance the piston rod 24 for thereby permitting the through hole 40 of the stopper 21 be positioned in the turning track of the mandrel 7 while the working fluid is supplied through the tube 26 to the rear chamber of the power cylinder 12 and the working fluid is exhausted from the front chamber of the power cylinder 12 through the tube 25 to advance the piston rod 13. Accordingly, as the piston rod 13 is advanced, the rotary shaft 9 is turned with the rack 11 engaging the pinion 10 to turn the movable block 6 to move toward the fixed die 1. As the movable block 6 is thus turned, the mandrel 7 and the ejecting rod 8 are turned together with the movable block 6 so that the mandrel 7 passes through the through hole 40 of the stopper 21 and remains in the curved cavity 4 of the fixed die 1 while the ejecting rod is removed from the curved cavity 4 of the fixed die 1. At this state, the projection 38 actuates the sensor 42. Then, the sensor 42 gives a signal to set the selector valve 33 at the position b, and the selector valve 35 at the position d to the controller 51. Consequently, the supply of working fluid to the power cylinder 12 is interrupted to stop the advancing motion of the piston rod 13; the working fluid is supplied through the tube 30 into the rear chamber of the power cylinder 19, and the working fluid is exhausted from the front chamber of the power cylinder 19 through the tube 29 to advance the piston rod 20, whereby the movable pipe supporting member 18 holding the work is moved again towards the entrance opening 2 of the fixed die 1 by the piston rod 20.

A series of the foregoing actions is repeated to effect successively the pipe bending process automatically. The work 5 is supplied to the movable pipe supporting member 18 while the movable pipe supporting member 18 is positioned away from the fixed die 1 as illustrated in the imaginary lines of FIG. 4.

To subject a work 5 having a different outside diameter and inside diameter to the pipe bending process, another mandrel 7 having a diameter corresponding to the inside diameter of the work 5 and another ejecting rod 8 having a diameter corresponding to the outside diameter of the work 5 are attached to the movable block 6; the fixed die 1 is replaced by another fixed die 1 having a curved cavity 4 corresponding to the external shape of a curved pipe to be formed; another presser rod 14 having a diameter corresponding to the outside diameter of the work 5 is screwed onto the free end of the piston rod 15; another movable supporting member 18 suitable for supporting the new work 5 is connected to the piston rod 20.

The working fluid may be a hydraulic oil or compressed air. The pressure generating machine is an oil pump or an air compressor.

Figure 5:
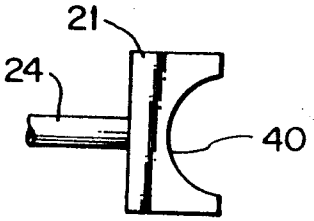
FIG. 5 is a plan view of a stopper according to another embodiment of the present invention.
Figure 6:
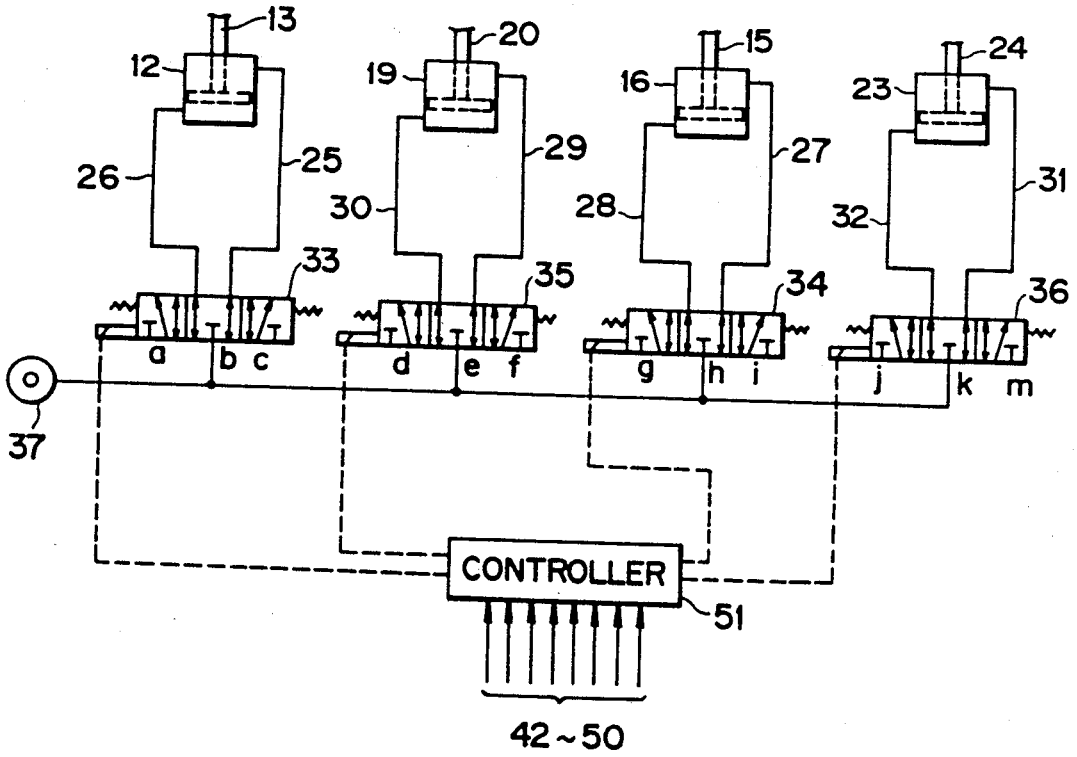
FIG. 6 is a circuit diagram of a controller for controlling the operation of the curved pipe manufacturing apparatus of FIG. 1.
Figure 7:
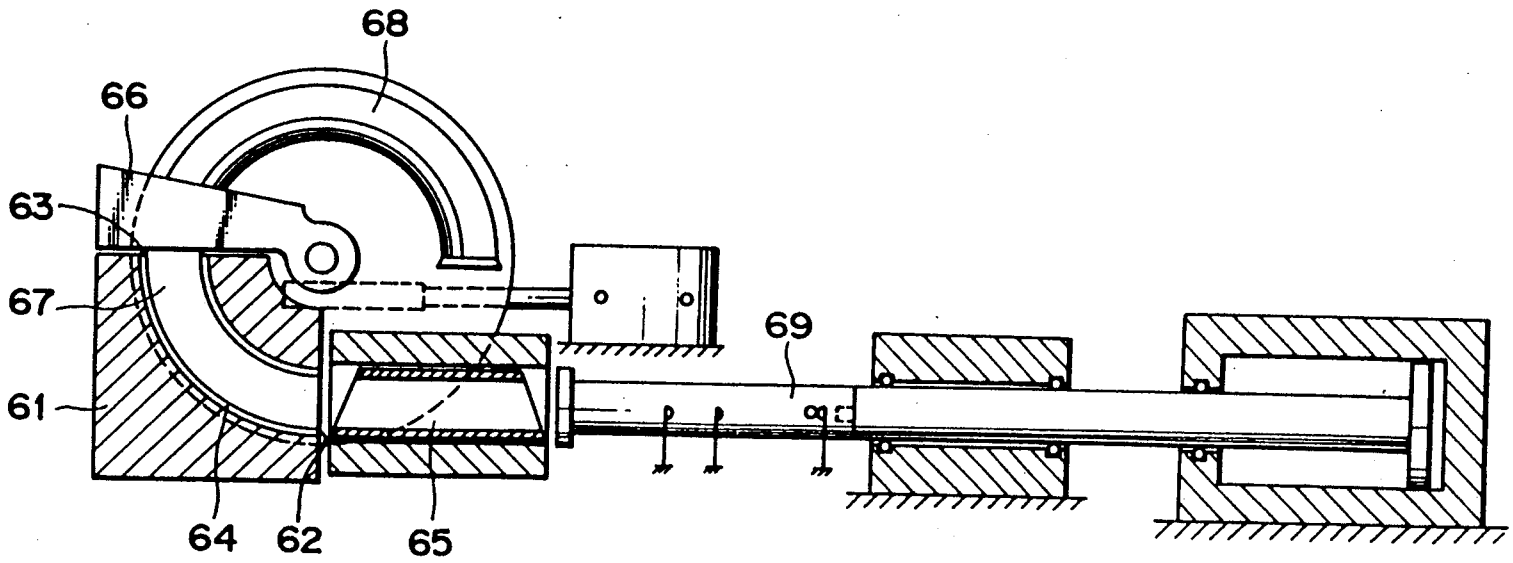
FIG. 7 (PRIOR ART)
FIG. 7 is a sectional side elevation view of a prior curved pipe manufacturing apparatus.

Second Embodiment (FIG. 5)

The stopper 21 has the through hole of a complete circular shape according to the first embodiment, but it may have a through hole of an irregular circular shape as shown in FIG. 5.

Other components are same as those of the first embodiment.

Although the invention has been described as applying to a horizontal curved pipe manufacturing apparatus, the present invention is not limited thereto in its application. The present invention is applicable also to a vertical curved pipe manufacturing apparatus.

Although the invention has been described in its preferred form with a certain degree of particularity, it is to be understood that many variations and changes are possible in the invention without departing from the scope and spirit thereof.

What is claimed is:

1. A curved pipe manufacturing method comprising the steps of:

(1) providing a fixed die having a curved cavity, an entrance opening and an exit opening contained therein, said curved cavity being formed in a circular arc and extending from said entrance opening to said exit opening;

(2) providing a movable block having a curved mandrel attached to a first side thereof and a curved ejecting rod attached to a second side thereof opposite said first side, said curved mandrel and said curved ejecting rod being concentrically mounted on said movable block with respect to each other;

(3) inserting the curved mandrel into the curved cavity of the fixed die through the exit opening therein and forming a curved annular chamber therein;

(4) pressing a work with a presser rod through said entrance opening into said curved annular chamber to form a curved pipe;

(5) positioning a stopper directly adjacent said exit opening of said fixed die, said stopper having a through hole provided in an outermost portion which is adapted to allow the passage of said mandrel therethrough during the removal of said mandrel from said curved cavity but prevent the removal of said curved pipe from said curved cavity by restraining a tip end thereof;

(6)removing the mandrel from the fixed die exit opening and through the stopper through hole so that said mandrel is removed from said curved cavity without the accompanying removal of said curved pipe;

(7) inserting the ejecting rod into the fixed die entrance opening to eject said curved pipe from said curved cavity through said exit opening; and (8) recovering said curved pipe.

2. A curved pipe manufacturing method according to claim 1, additionally comprising the step of removing said stopper from said position directly adjacent said fixed die exit opening when said mandrel is completely removed therefrom.

3. A curved pipe manufacturing apparatus comprising:

a fixed die having a curved cavity, an entrance opening and an exit opening contained therein, said curved cavity being formed in a circular arc and extending from said entrance opening to said exit opening;

a movable block having a curved mandrel attached to a first side thereof and a curved ejecting rod attached to a second side thereof opposite to said first side, said curved mandrel and said curved ejecting rod being concentrically mounted on said movable block with respect to each other and said mandrel being mounted for movement into said fixed die curved cavity through said fixed die exit opening and said ejecting rod being mounted for movement into said fixed die curved cavity through said entrance opening, a stopper provided adjacent said exit opening of said fixed die and containing a through hole in an outermost portion, said stopper being mounted for reciprocating movement between a first retracted position and a second extended position at which said stopper outermost portion is positioned directly adjacent said exit opening of said fixed die and engages with said fixed die groove during the insertion of said mandrel through said exit opening and into said curved cavity, said through hole being sized so as to allow the movement of the mandrel therethrough and prevent the movement of a formed curved pipe from said curved cavity during the removal of the mandrel therefrom;

a presser rod for pressing a work into the curved annular chamber through the entrance opening of said fixed die; and controller means for regulating the reciprocating movement of said stopper.

4. A curved pipe manufacturing apparatus according to claim 3, wherein the stopper has a through hole of a circular shape.

5. A curved pipe manufacturing apparatus according to claim 3, wherein the stopper has a through hole of a semi-circular shape.

6. A curved pipe manufacturing apparatus according to claim 3, wherein the movable block is mounted on a rotatable shaft.

* * * * *